US006138887A

United States Patent [19]

Nayrac et al.

[11] Patent Number: 6,138,887

[45] Date of Patent: Oct. 31, 2000

[54] FIXING DEVICE WITH A PISTON PROPELLED BY COMPRESSED GAS

[75] Inventors: Frédéric Nayrac, Valence; Guy Jaillet, La Rouche de Glun; Patrick Herelier, Saint Jean de Muzols, all of France

[73] Assignee: Societe de Prospection et d'Inventions Techniques Spit, Bourg les Valence, France

[21] Appl. No.: 09/237,836

[22] Filed: Jan. 27, 1999

[30] Foreign Application Priority Data

Jan. 27, 1998 [FR] France ..... 98 00840

[51] Int. Cl.[7] ..... B25C 1/08

[52] U.S. Cl. ..... 227/8; 227/10; 227/130

[58] Field of Search ..... 227/9, 10, 11, 227/130, 8

[56] References Cited

U.S. PATENT DOCUMENTS

| | | | |
|---|---|---|---|
| 4,405,072 | 9/1983 | Kindle et al. . | |
| 5,197,646 | 3/1993 | Nikolich . | |
| 5,261,587 | 11/1993 | Robinson | 227/8 |
| 5,263,626 | 11/1993 | Howard et al. | 227/8 |
| 5,263,842 | 11/1993 | Fealey . | |
| 5,320,268 | 6/1994 | Shkolnikov et al. | 227/8 |
| 5,495,973 | 3/1996 | Ishizawa et al. | 227/130 |
| 5,687,899 | 11/1997 | Dohi et al. | 227/10 |

FOREIGN PATENT DOCUMENTS

| | | |
|---|---|---|
| 0 727 285 | 8/1996 | European Pat. Off. . |
| 0 788 863 | 8/1997 | European Pat. Off. . |

*Primary Examiner*—Scott A. Smith
*Attorney, Agent, or Firm*—Lowe Hauptman Gopstein Gilman & Berner

[57] ABSTRACT

The device for fixing a plug in a support (100), with a piston (6) propelled by compressed gas, comprises a cylinder (5) in which the piston (6) is mounted, a combustion chamber (3), a combustion chamber sleeve (4) intended to close the chamber (3) at the rear with a cylinder head (2) and at the front with the piston (6) and the cylinder (5), a plug guide (8) acting as a probe for placing in abutment and for closing the combustion chamber (3). A pushing surface (30) and an abutment surface (29), which are respectively fixedly attached to the plug guide (8) and to the sleeve (4), are arranged to be fixedly attached to each other in a rearward translational movement when the plug guide (8) is placed into abutment, in order to close the combustion chamber (3), and to become detached from each other upon recoil of the device in reaction to firing in order to ensure that the plug guide (8) is kept in abutment against the support (100).

8 Claims, 3 Drawing Sheets

FIXING DEVICE WITH A PISTON PROPELLED BY COMPRESSED GAS

BACKGROUND OF THE INVENTION

The invention relates to a plug fixing device with a piston propelled by compressed gas, comprising a plug guide, a cylinder in which the piston is mounted, a combustion chamber sleeve intended to close the chamber at the rear with a cylinder head and at the front with the piston and the cylinder, a probe for closing the chamber, a duct for injection of compressed gas into the chamber from a compressed gas cartridge and means for ignition intended to cause the gas contained in the combustion chamber to explode upon firing.

Upon firing, the gas explosion in the chamber induces a recoil force which tends to cause detachment of the device, and especially the plug guide, from the support material on which it is in abutment. Such detachment generally proves to be detrimental to the fixing of the plug which, instead of becoming embedded in the material, swerves or even breaks, in particular in the case where the material is hard, e.g. concrete.

In order to solve this problem the document EP-0 788 863 proposes a fixing device of the type defined above in which the plug guide acts as a probe for placing in abutment and for closing the combustion chamber, comprised of mechanical isolation springs disposed between the cylinder and a plug guide support fixedly attached to the plug. The cylinder is able to move forward with respect to the plug guide support against the action of the isolation springs. When the device is brought into abutment against the material, the cylinder is driven forward and compresses the springs. Then, upon firing and under the action of the recoil force, the cylinder recoils and releases the springs, the plug guide thus being kept in abutment against the material with the aid of the isolation springs.

A device of this type has a relatively complex structure. Moreover, when the device is brought into abutment, an operator must exert a force to compress the isolation spring.

SUMMARY OF THE INVENTION

The present invention aims to overcome these problems.

The the invention relates to a device for fixing a plug into a support, with a piston propelled by compressed gas, comprising a cylinder in which are mounted the piston, a combustion chamber, a combustion chamber sleeve intended to close the chamber at the rear with a cylinder head and at the front with the piston and the cylinder, and a plug guide acting as a probe for placing in abutment and for closing the combustion chamber. The device comprises a pushing surface and an abutment surface which are respectively fixedly attached to the plug guide and to the sleeve and are arranged to be fixedly attached together in a translational movement towards the rear when the plug guide is brought into abutment, in order to close the combustion chamber, and to become detached from each other upon recoil of the device in reaction to firing in order to ensure that the plug guide is kept in abutment against the support.

The sleeve and the probe plug guide cooperate by simple abutment without being fixed to each other in order to close the combustion chamber. The sleeve can recoil without driving the plug guide at the time of the recoil in reaction to the explosion of the compressed gas in the combustion chamber.

The device advantageously comprises means for rearwardly driving the sleeve, which are fixedly attached to the sleeve and to which the front abutment surface is fixedly attached.

It is also advantageous that the driving means comprise at least one driving arm which is fixedly attached, at one end thereof, to an abutment finger provided with the front abutment surface. In this case, the plug guide can comprise a groove for reception of the abutment finger and provided with a front wall acting as a pushing surface.

In one particular embodiment, the device comprises a housing to which the cylinder is fixedly attached and a plug guide support fixedly attached to the cylinder, in which the plug guide is mounted in a sliding manner.

In the prior art, the cylinder could move with respect to the plug guide support fixedly attached to the plug guide, whereas in the invention the cylinder is fixedly attached to the plug guide support in which the plug guide is mounted in a sliding manner, which proves to be a more simple structure to produce.

The fixing device can also comprise means for returning the driving means towards the front in order to return the plug guide towards the front into an inoperative position when it is removed from abutment.

BRIEF DESCRIPTION OF THE DRAWING

The invention will be better understood with the aid of the following description of a particular embodiment of the fixing device of the invention with reference to the attached drawing in which.

DETAILED DESCRIPTION OF THE INVENTION

Figure 1:
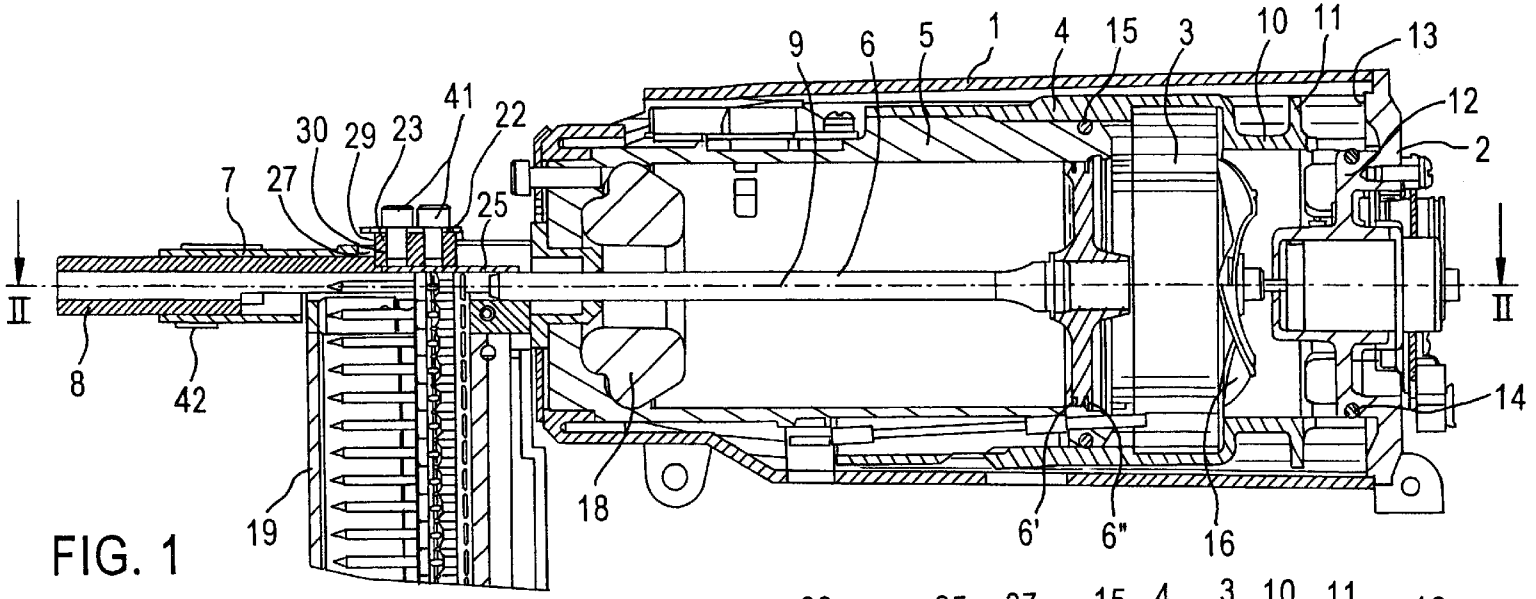
FIG. 1 is an axial cross-sectional view of the fixing device in the inoperative state.

The fixing device comprises, a housing 1 containing a rear cylinder head 2, a combustion chamber 3, a combustion chamber sleeve 4, a cylinder 5, a piston 6, a plug guide 8 and a plug guide support 7. All these elements of the device are on the axis 9. The piston 6, provided with a rear head, is mounted in a sliding manner in the cylinder 5 which is fixedly attached to the housing 1.

The plug guide 8, protruding out of the housing 1 at the front, is mounted in a sliding manner in the plug guide support 7 which is fixedly attached to the housing 1. The sliding of the plug guide 8 in the plug guide support 7 is limited by a bushing 42 fixedly attached to the plug guide support 7, comprising a rear part mounted around the plug guide support 7 and a narrow rear part 44 surrounding the plug guide 8 at a right angle to an opening 47 provided in the plug guide support 7. The rear part 44 of the bushing 42 is mounted in a sliding manner on the plug guide 8 between a front stop 45 and a rear stop 46 of the plug guide 8 in order to limit the relative sliding thereof with respect to the plug guide support 7.

The combustion chamber sleeve 4 is mounted in a sliding manner on the cylinder 5 and comprises, a rear collar 10 provided with a rear annular edge 11 intended to be pressed against a corresponding part 12 of the cylinder head 2 until the edge 11 comes into abutment against a corresponding surface 13 of the cylinder head 2 in order to close the combustion chamber 3 at the rear. The part 12 comprises an external annular groove comprising a seal 14. The sleeve 4 is also intended to close the combustion chamber 3 at the front with the piston 6 and the cylinder 5 which, at the rear, has an external annular groove with a seal 15. The seals 14 and 15 are intended to seal between the sleeve 4 and the cylinder head 2 and between the cylinder 5 and the sleeve 4 respectively.

The head of the piston 6 has two external peripheral annular grooves with seals 6', 6" (FIG. 1) intended to seal between the cylinder 5 and the piston head 6.

The device also comprises a housing for reception of a cartridge of compressed gas, not illustrated. An injection duct connected to the compressed gas cartridge opens into the combustion chamber 3 via the cylinder head 2 for injection of compressed gas into the chamber 3. The injection duct is not illustrated.

The cylinder head 2 has a mixing fan 16, an ignition device, not illustrated, and a switch 17 for controlling the fan 16 intended to be actuated by the rear edge 11 of the collar 10 when this collar comes into abutment against the surface 13 of the cylinder head 2.

The front of the cylinder 5 contains a shock absorber 18, fixedly attached to the cylinder 5, against which the head of the piston 6, which is propelled forwards upon firing, is intended to come into abutment.

A magazine 19 for the supply of plugs communicates with the plug guide 8 for loading plugs into the plug guide 8.

Two arms 20, 21 for driving the sleeve 4 rearwards, which are symmetrical to each other with respect to the axis 9, extend substantially along and outside the plug guide support 7 and the cylinder 5 and are fixedly attached, in this case by screwing, to the sleeve 4 at their rear ends.

The two driving arms 20, 21 are connected to each other by a connection part 22 at their front ends. An abutment finger 23 provided with an abutment surface 29 oriented towards the front is fixed, in this case by screwing with the aid of screws 41, to the connection part 22. The finger 23 extends through a hole 27 provided in the plug guide support 7 and is received in an external groove 25 provided in the plug guide 8 and parallel to the axis 9. The front wall of the groove 25, oriented towards the rear, acts as a pushing surface 30. The pushing surface 30 and the abutment surface 29 are intended to become fixedly attached to each other in rearward translational movement by abutting one against the other when the plug guide 8 is placed into abutment against a support in order to close the combustion chamber 3, and in order to become detached from each other upon recoil of the device in reaction to firing in order to ensure that the plug guide 8 is kept in abutment against the support as will be explained in more detail in the description of the operation of the device. The connection part 22 has an aperture 48 for passage of screws 41 extending parallel to the axis 9 and making it possible to axially shift the finger 23 and the assembly of the two arms 20, 21 and of the part 22 depending on the desired penetration of the plug into the support.

The plug guide 8 acts as a probe for placing in abutment and for closing the combustion chamber 3 by means of the driving arms 20, 21.

Each of the driving arms 20, 21 comprises, in the vicinity of its rear end, a pushing finger 24, 26, respectively, bent towards the cylinder 5 substantially at a right angle. The two pushing fingers 24, 26 are mounted in a sliding manner on the cylinder 5 respectively against the action of two springs 35, 36, for forwards return movement, which are in abutment at the rear against two abutment surfaces 37, 38 of the cylinder 5 and at the front against the fingers 24, 26. The springs 35, 36 are intended to return the driving arms 20, 21, and consequently the sleeve 4, to the front into an inoperative position when the device comes out of abutment as will be explained in the description of the operation of the device.

The cylinder 5 also comprises two external front stops 39, 40 for the fingers 24, 26, symmetrical to each other with respect to the axis 9 and intended to limit the forwards sliding of the arms 20, 21 with respect to the cylinder 5.

Following the structural description of the fixing device with a propelled piston, its operation will now be described.

In the inoperative position

Figure 2:
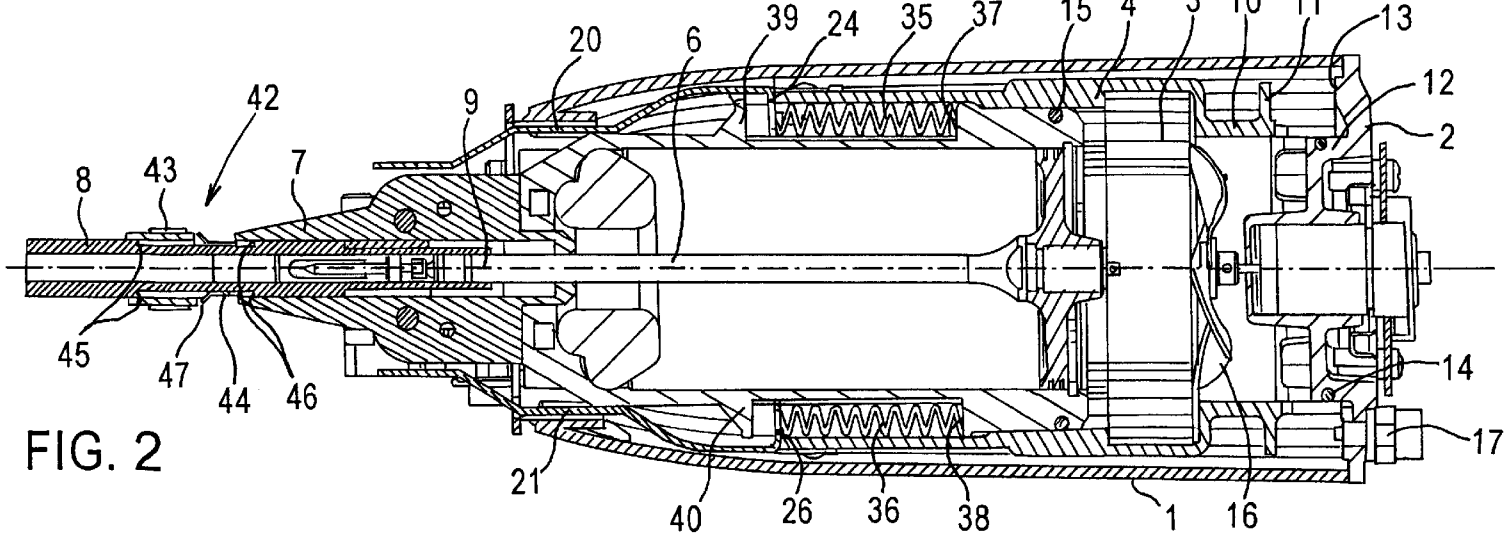
FIG. 2 is an axial cross-sectional view of the fixing device of FIG. 1, in the inoperative state, in the plane of cut II—II perpendicular to the plane of cut of FIG. 1.

In the inoperative position of the device (FIGS. 1 and 2), the driving arms 20, 21, the sleeve 4 and the plug guide 8, by means of the surfaces 29 and 30 being in abutment against each other, are returned towards the front by the springs 35, 36 and the combustion chamber 3 is opened at the rear.

Bringing the apparatus into abutment against a support 100

Figure 3:
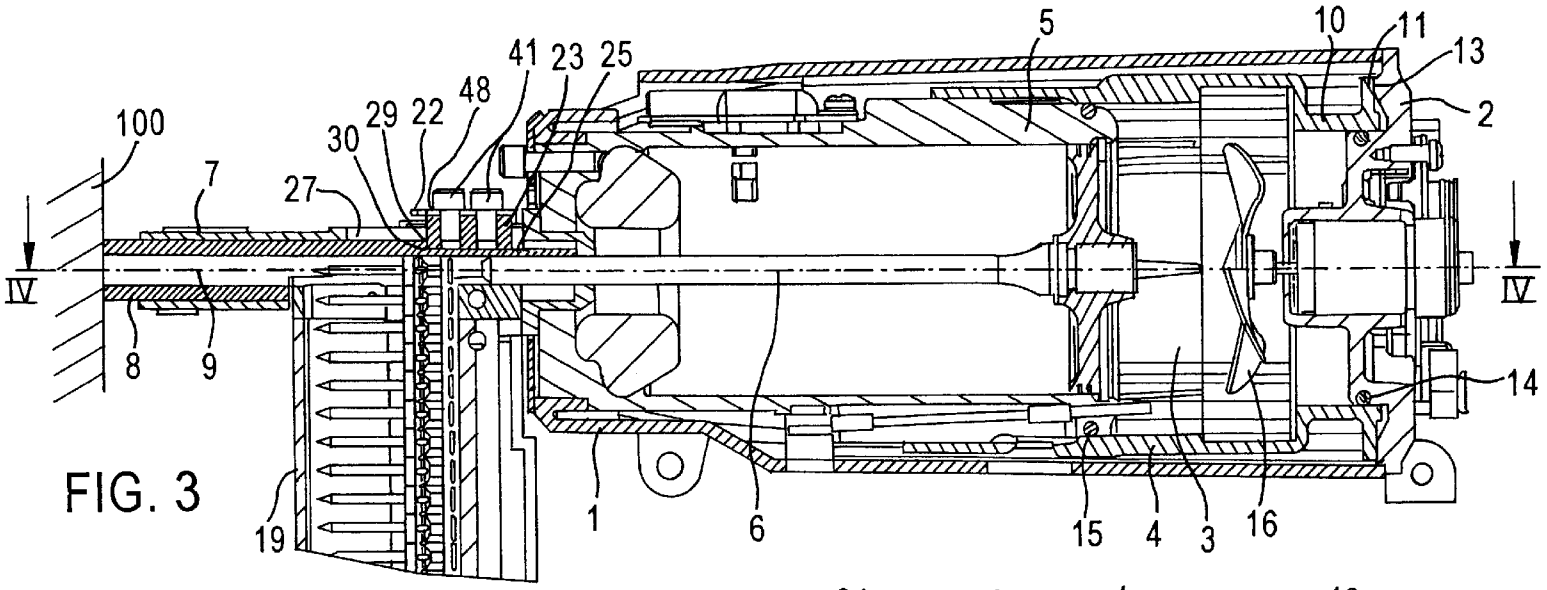
FIG. 3 is a cross-sectional view of the device of FIG. 1 when placed in abutment, in the plane of cut of FIG. 1.
Figure 4:
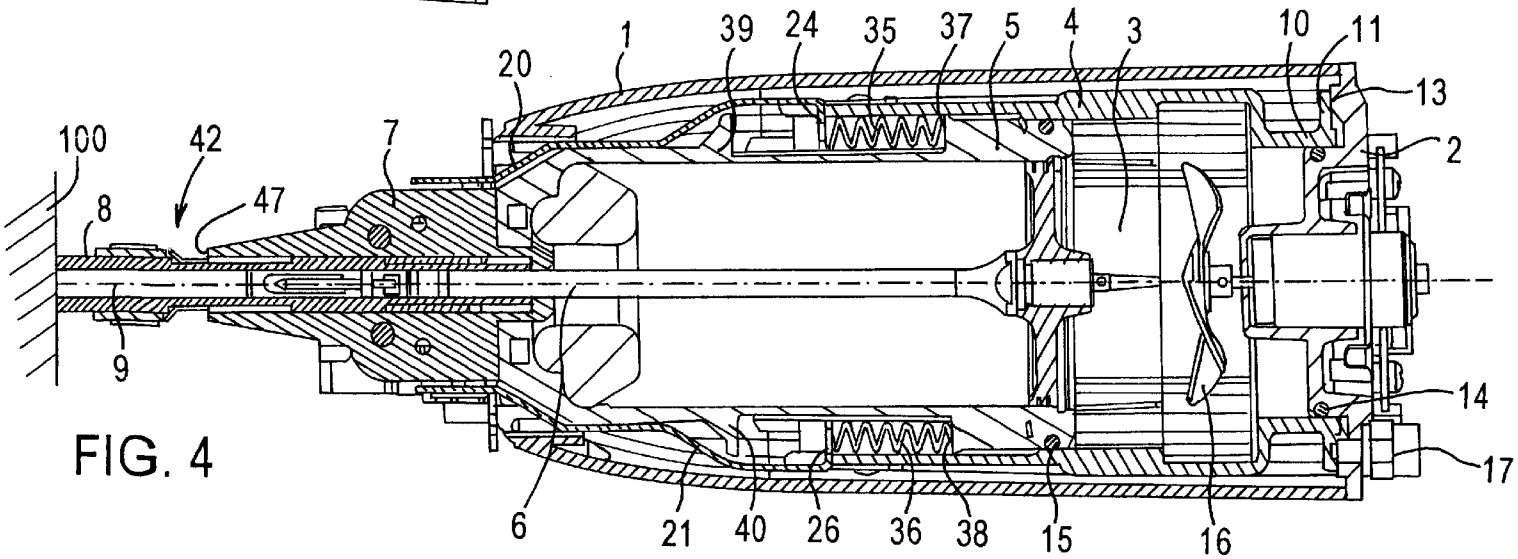
FIG. 4 is a cross-sectional view of the apparatus of FIG. 3, when placed in abutment, in the plane of cut IV—IV perpendicular to the plane of cut of FIG. 3
Figure 5:
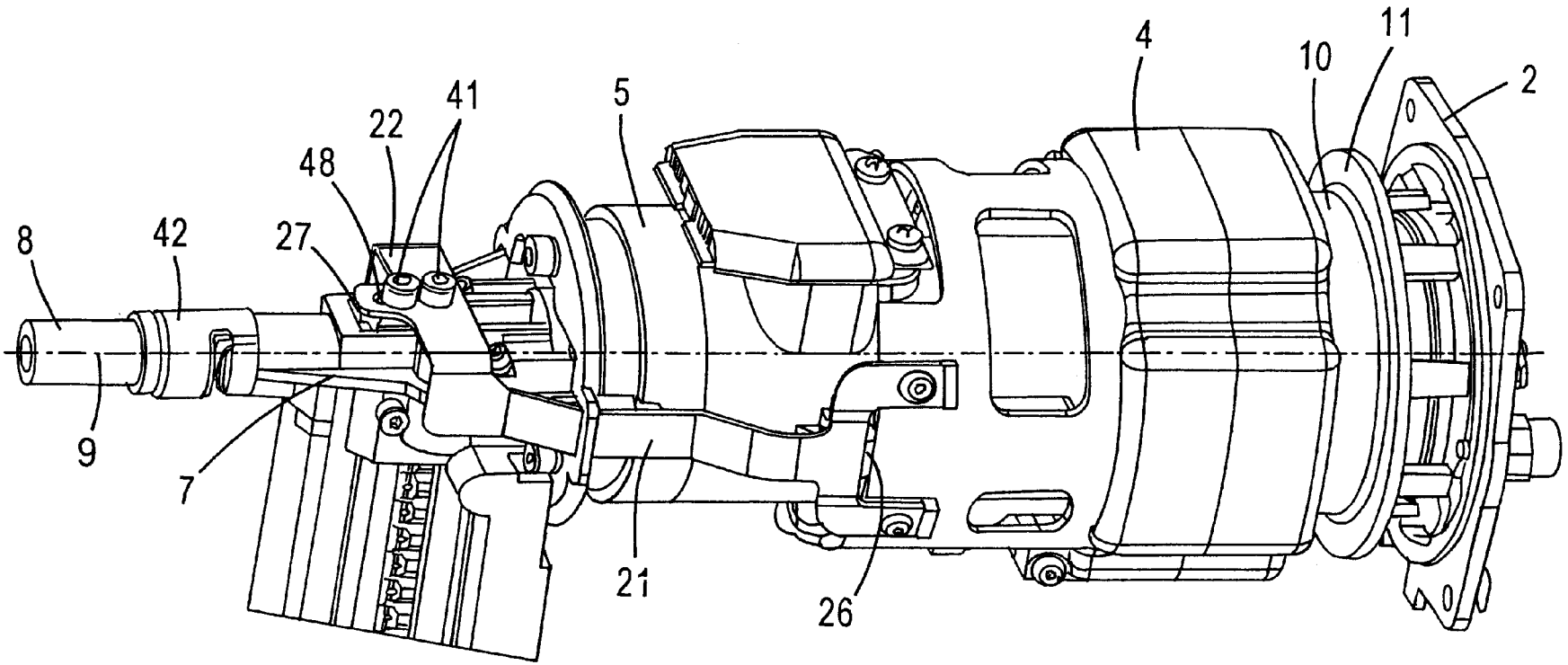
FIG. 5 is a perspective view of the device of FIG. 1 without a housing.

When the device is brought into abutment against the support 100 (FIGS. 3 and 4), the plug guide 8 is driven rearwards with respect to the plug guide support 7, to the cylinder 5 and forwards the housing 1. The pushing surface 30 of the plug guide 8 and the abutment surface 29 fixedly attached to the driving arms 20, 21, which are in abutment one against the other, are fixedly attached in a translational movement towards the rear. Consequently, under the action of the displacement of the plug guide 8, the driving arms 20, 21 drive the sleeve 4 to the rear until the rear edge 11 of the collar 10 of the sleeve 4 comes into abutment against the surface 13 of the cylinder head 2. When the sleeve 4 is in this position the combustion chamber 3 is closed at the rear by the cylinder head 2 and at the front by the head of the piston 6 and the cylinder 5 (FIGS. 3 and 4).

It is emphasized at this point that the rearwards driving of the sleeve 4 by the plug guide 8 is achieved by a simple pushing of the sleeve by the plug guide.

The driving arms 20, 21 are made to recoil against the action of return springs 35, 36 which are compressed.

During the recoil of the sleeve 4, gas is injected into the combustion chamber 3 from the compressed gas cartridge. When the collar 10 of the sleeve 4 comes into abutment against the cylinder head 2 at the rear, its edge 11 actuates the switch 17 which starts the fan 16 in order to agitate the contents of the chamber 3.

Firing

Upon firing, the ignition device causes the compressed gas contained in the combustion chamber 3 to explode, which creates pressure inside the chamber 3, under the effect of which the piston 6 is propelled forwards. A plug having been positioned in the plug guide 8, the piston 6 comes to strike the plug which is propelled forwards and is fixed in the support 100. At the end of travel, the head of the piston 6 abuts against the shock absorber 18.

In reaction, the firing causes a recoil force which tends to cause the device to recoil. The cylinder head-housing-cylinder-plug guide support-sleeve-driving arms assembly 2, 1, 5, 7, 4, 20, 21 recoils. On the other hand, during recoil the abutment surface 29 of the finger 2, which is fixedly attached to the arms 20, 21, becomes detached from the pushing surface 30 of the plug guide 8 so that the plug guide 8 does not recoil and the abutment finger 23 slides to the rear in the reception groove 25. By reason of this the plug guide 8 is kept in abutment against the support 100 in spite of the recoil of the cylinder head-housing-cylinder-plug guide support-sleeve-driving arms assembly 2, 1, 5, 7, 4, 20, 21.

At the end of the travel of the piston 6, the combustion gases escape from the cylinder 5 and from the combustion chamber 3, in a known manner, by way of an exhaust valve. The piston 6 is driven towards the rear by negative pressure and returns to the inoperative position.

Moving out of abutment

When the device is moved out of abutment, the return springs 35, 36 relax and drive forwards the driving arms 20, 21, the plug guide 8 and the sleeve 4 which return to the inoperative position.

The combustion chamber 3 thus opens again at the rear.

What is claimed is:

1. Device for fixing a plug in a support (100), comprising a piston (6) adapted to be propelled by compressed gas, a cylinder (5) in which the piston (6) is mounted, a combustion chamber (3) formed between the piston and a cylinder head (2), a combustion chamber sleeve (4) movably mounted to close the chamber (3) at a rear thereof through contact with the cylinder head (2), a plug guide (8) acting as a probe for placement in abutment with the support (100) said plug guide (8) including a pushing surface (30) and said sleeve (4) supporting an abutment surface (29) which surfaces (30, 29) are arranged to be fixedly attached to each other during rearward translational movement of the sleeve (4) when the plug guide (8) is placed into abutment with said support (100) and which rearward displacement of the sleeve (4) closes the combustion chamber (3), said surfaces (30, 29) detaching from each other upon recoil of the device in reaction to firing in order to ensure that the plug guide (8) is kept in abutment against the support (100) during said recoil, said plug guide (8) being in coaxial alignment with one of said plugs in a firing position to thereby guide said plug upon firing.

2. Device according to claim 1, comprising at least one connection member (20, 21) which are fixedly attached to the sleeve (4) and to which connection member said abutment surface (29) is fixedly attached for rearwards driving of the sleeve (4).

3. Device according to claim 2, wherein the at least one connection member comprises at least one driving arm (20, 21) fixedly attached, at one of end thereof, to an abutment finger (23) provided with said abutment surface (29).

4. Device according to claim 3, wherein the plug guide (8) comprises a groove (25) for receiving the abutment finger (23), said groove including a front wall acting as said pushing surface (30).

5. Device according to claim 1, further comprising a housing (1), to which the cylinder (5) is fixedly attached, and a plug guide support (7) fixedly attached to the cylinder (5), in which plug guide support the plug guide (8) is mounted in a sliding manner.

6. Device according to claim 3, further comprising means (35, 36) for returning said at least one driving arm towards the front.

7. Fixing device according to claim 6, wherein the returning means (35, 36) are in abutment at a rear portion thereof against the cylinder (5) and are arranged to cooperate at a front portion thereof with at least one said finger (24, 26) fixedly attached to the at least one driving arm in order to return the sleeve (4) to the front when the device is removed from abutment with the support (100) after firing.

8. A combustion power tool for driving a member through a surface and into a material having said surface, comprising:

a piston and cylinder defining a combustion chamber;

a combustion chamber sleeve movably mounted relative to the chamber to close said chamber when the sleeve is moved into a rearward position;

a nosepiece disposed forwardly of said piston and cylinder, said nosepiece including a guide located inside the nosepiece and adapted for being positioned in coaxial alignment with said member in a firing position to thereby guide said member into and through said surface upon firing;

said guide being operatively connected to said sleeve to thereby move said sleeve in rearward translational movement when the guide is place into abutment with said surface and which rearward translational movement also moves said sleeve to close said combustion chamber.

* * * * *

US006138887C1

(12) EX PARTE REEXAMINATION CERTIFICATE (5049th)

United States Patent
Nayrac et al.

(10) Number: US 6,138,887 C1
(45) Certificate Issued: Dec. 28, 2004

(54) FIXING DEVICE WITH A PISTON PROPELLED BY COMPRESSED GAS

(75) Inventors: Frédéric Nayrac, Valence (FR); Guy Jaillet, La Rouche de Glun (FR); Patrick Herelier, Saint Jean de Muzols (FR)

(73) Assignee: Societe de Prospection et d'Inventions Techniques SPIT, Bourg les Valence (FR)

Reexamination Request:
No. 90/006,735, Aug. 7, 2003

Reexamination Certificate for:

| | |
|---|---|
| Patent No.: | **6,138,887** |
| Issued: | **Oct. 31, 2000** |
| Appl. No.: | **09/237,836** |
| Filed: | **Jan. 27, 1999** |

(30) Foreign Application Priority Data

Jan. 27, 1998 (FR) ..... 98 00840

(51) Int. Cl.[7] ..... B25C 1/08
(52) U.S. Cl. ..... 227/8; 227/10; 227/130
(58) Field of Search ..... 227/8, 9, 10, 11, 227/130; 60/632, 633

(56) References Cited

U.S. PATENT DOCUMENTS 4,483,473 A 11/1984 Wagdy
5,197,646 A 3/1993 Nikolich

FOREIGN PATENT DOCUMENTS

EP 0 788 863 A1 8/1997

*Primary Examiner*—Rinaldi I. Rada

(57) ABSTRACT

The device for fixing a plug in a support (100), with a piston (6) propelled by compressed gas, comprises a cylinder (5) in which the piston (6) is mounted, a combustion chamber (3), a combustion chamber sleeve (4) intended to close the chamber (3) at the rear with a cylinder head (2) and at the front with the piston (6) and the cylinder (5), a plug guide (8) acting as a probe for placing in abutment and for closing the combustion chamber (3). A pushing surface (30) and an abutment surface (29), which are respectively fixedly attached to the plug guide (8) and to the sleeve (4), are arranged to be fixedly attached to each other in a rearward translational movement when the plug guide (8) is placed into abutment, in order to close the combustion chamber (3), and to become detached from each other upon recoil of the device in reaction to firing in order to ensure that the plug guide (8) is kept in abutment against the support (100).

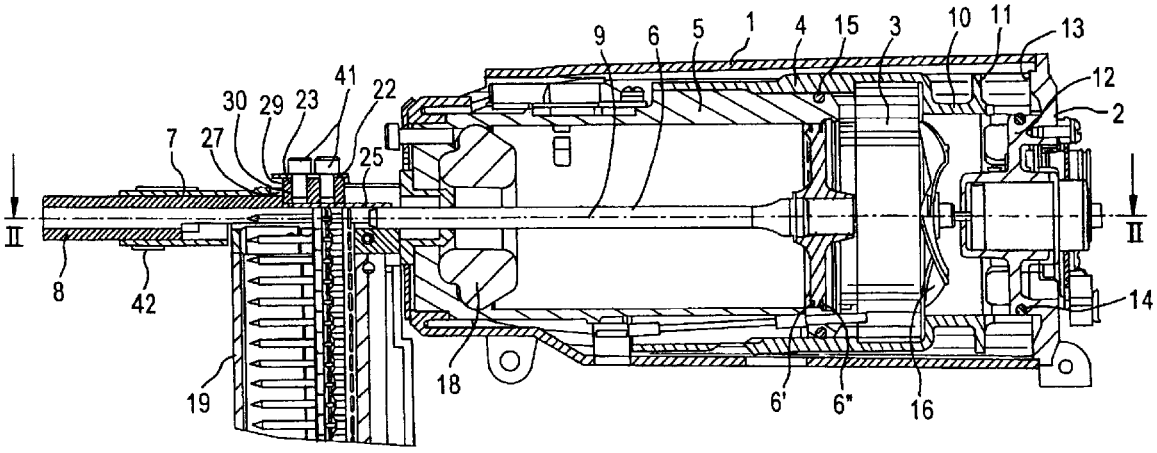

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–7 is confirmed.

Claim 8 is cancelled.

New claims 9–11 are added and determined to be patentable.

*9. A combustion power tool for driving a member through a surface and into a material having said surface, comprising:*

*a piston and cylinder defining a combustion chamber;*

*a combustion chamber sleeve movably mounted relative to the chamber to close said chamber when the sleeve is moved into a rearward position;*

*a nosepiece disposed forwardly of said piston and cylinder, said nosepiece including a guide located inside the nosepiece and adapted for being positioned in coaxial alignment with said member in a firing position to thereby guide said member into and through said surface upon firing;*

*said guide being operatively connected to said sleeve to thereby move said sleeve in rearward translational movement when the guide is place into abutment with said surface and which rearward translational movement also moves said sleeve to close said combustion chamber;*

*wherein the sleeve is moveable relative to the guide at least upon recoil.*

*10. A combustion power tool for driving a member through a surface and into a material having said surface, comprising:*

*a piston and cylinder defining a combustion chamber;*

*a combustion chamber sleeve movably mounted relative to the chamber to close said chamber when the sleeve is moved into a rearward position;*

*a nosepiece disposed forwardly of said piston and cylinder, said nosepiece including a guide located inside the nosepiece and adapted for being positioned in coaxial alignment with said member in a firing position to thereby guide said member into and through said surface upon firing;*

*said guide being operatively connected to said sleeve to thereby move said sleeve in rearward translational movement when the guide is place into abutment with said surface and which rearward translational movement also moves said sleeve to close said combustion chamber;*

*wherein the sleeve and the guide cooperate by abutment without being fixed to each other.*

*11. A combustion power tool for driving a member through a surface and into a material having said surface, comprising:*

*a piston and cylinder defining a combustion chamber;*

*a combustion chamber sleeve movably mounted relative to the chamber to close said chamber when the sleeve is moved into a rearward position;*

*a nosepiece disposed forwardly of said piston and cylinder, said nosepiece including a guide located inside the nosepiece and adapted for being positioned in coaxial alignment with said member in a firing position to thereby guide said member into and through said surface upon firing;*

*said guide being operatively connected to said sleeve to thereby move said sleeve in rearward translational movement when the guide is place into abutment with said surface and which rearward translational movement also moves said sleeve to close said combustion chamber;*

*wherein the sleeve detaches from the guide upon recoil.*

* * * * *

US006138887C2

(12) EX PARTE REEXAMINATION CERTIFICATE (5304th)

United States Patent
Nayrac et al.

(10) Number: US 6,138,887 C2
(45) Certificate Issued: Mar. 14, 2006

(54) FIXING DEVICE WITH A PISTON PROPELLED BY COMPRESSED GAS

(75) Inventors: Frédéric Nayrac, Valence (FR); Guy Jaillet, La Rouche de Glun (FR); Patrick Herelier, Saint Jean de Muzols (FR)

(73) Assignee: Societe de Prospection et d'Inventions Techniques SPIT, Bourg les Valence (FR)

Reexamination Request:
No. 90/007,272, Oct. 28, 2004

Reexamination Certificate for:

| | |
|---|---|
| Patent No.: | **6,138,887** |
| Issued: | **Oct. 31, 2000** |
| Appl. No.: | **09/237,836** |
| Filed: | **Jan. 27, 1999** |

Reexamination Certificate B1 6,138,887 issued Dec. 28, 2004

(30) Foreign Application Priority Data

Jan. 27, 1998 (FR) ..... 98 00840

(51) Int. Cl.
*B25C 1/08* (2006.01)

(52) U.S. Cl. ..... 227/8; 227/10; 227/130
(58) Field of Classification Search ..... 227/8, 227/9, 10, 11, 130
See application file for complete search history.

(56) References Cited

U.S. PATENT DOCUMENTS

| | | | |
|---|---|---|---|
| 4,403,722 | A | 9/1983 | Nikolich |
| 4,483,473 | A | 11/1984 | Wagdy |
| 4,483,474 | A | 11/1984 | Nikolich |
| 5,261,587 | A | 11/1993 | Robinson |
| 5,263,626 | A | 11/1993 | Howard et al. |
| 6,138,887 | A | 10/2000 | Nayrac et al. |

FOREIGN PATENT DOCUMENTS

| | | |
|---|---|---|
| EP | 0 788 863 A1 | 8/1997 |

*Primary Examiner*—Louis Huynh

(57) ABSTRACT

The device for fixing a plug in a support (100), with a piston (6) propelled by compressed gas, comprises a cylinder (5) in which the piston (6) is mounted, a combustion chamber (3), a combustion chamber sleeve (4) intended to close the chamber (3) at the rear with a cylinder head (2) and at the front with the piston (6) and the cylinder (5), a plug guide (8) acting as a probe for placing in abutment and for closing the combustion chamber (3). A pushing surface (30) and an abutment surface (29), which are respectively fixedly attached to the plug guide (8) and to the sleeve (4), are arranged to be fixedly attached to each other in a rearward translational movement when the plug guide (8) is placed into abutment, in order to close the combustion chamber (3), and to become detached from each other upon recoil of the device in reaction to firing in order to ensure that the plug guide (8) is kept in abutment against the support (100).

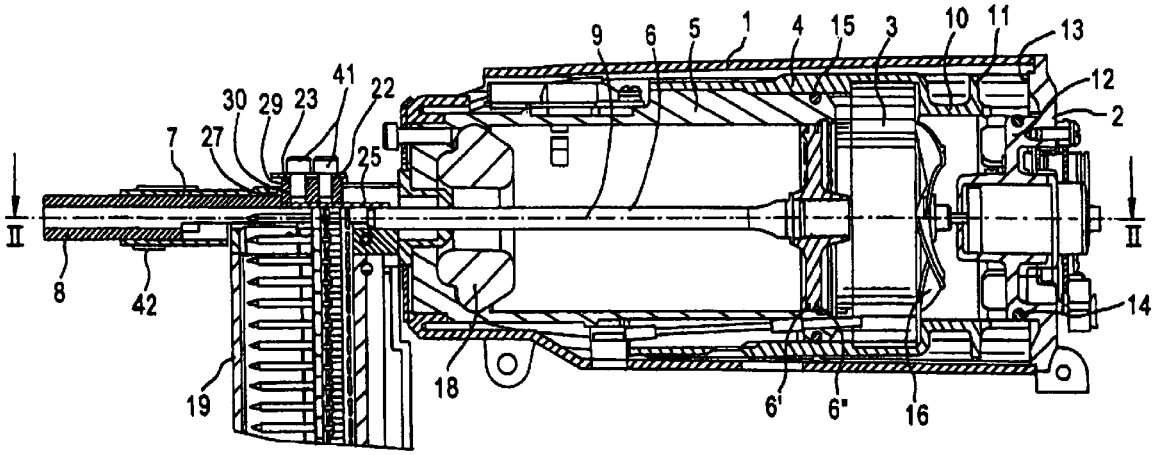

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–7 and 9–11 is confirmed. Claim 8 was previously cancelled.

* * * * *